US005129773A

United States Patent [19]

Shock

[11] Patent Number: 5,129,773

[45] Date of Patent: Jul. 14, 1992

[54] CONTAINER AND CLOSEABLE PULL TAB

[76] Inventor: John P. Shock, 1 Oakmont Ct., Little Rock, Ark. 72212

[21] Appl. No.: 776,919

[22] Filed: Oct. 15, 1991

Related U.S. Application Data

[62] Division of Ser. No. 574,637, Aug. 29, 1990, Pat. No. 5,080,249.

[51] Int. Cl.[5] ..... B21D 51/38

[52] U.S. Cl. ..... 413/25; 413/14

[58] Field of Search ..... 413/14, 16, 25; 72/335

[56] References Cited

U.S. PATENT DOCUMENTS

| | | | |
|---|---|---|---|
| 3,850,124 | 11/1974 | Brown | 413/25 |
| 4,130,074 | 12/1978 | Cudzik | 413/25 |
| 4,280,427 | 7/1981 | Potts | 413/15 |
| 4,372,462 | 2/1983 | Dassler | 220/269 |
| 4,463,866 | 8/1984 | Mandel | 220/269 |
| 4,465,204 | 8/1984 | Kaminski | 220/269 |
| 4,596,342 | 6/1986 | Zysset | 413/14 |
| 4,681,238 | 7/1987 | Sanchez | 220/260 |
| 4,979,635 | 12/1990 | Levine | 220/269 |

*Primary Examiner*—Bruce M. Kisliuk
*Assistant Examiner*—Jack Lavinder
*Attorney, Agent, or Firm*—Pennie & Edmonds

[57] ABSTRACT

A pull tab for a metal container. The pull tab has a cover portion of a size at least as large as the container opening for covering said opening after rupturing of said score line.

6 Claims, 4 Drawing Sheets

FIG. 4
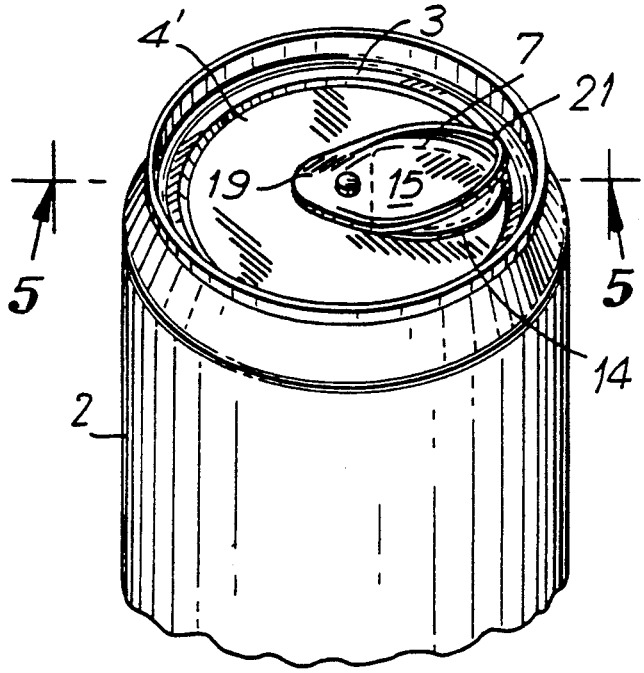
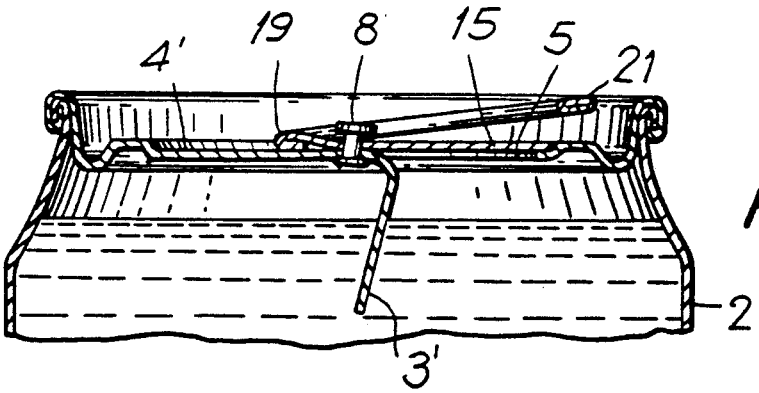
FIG. 5
FIG. 6
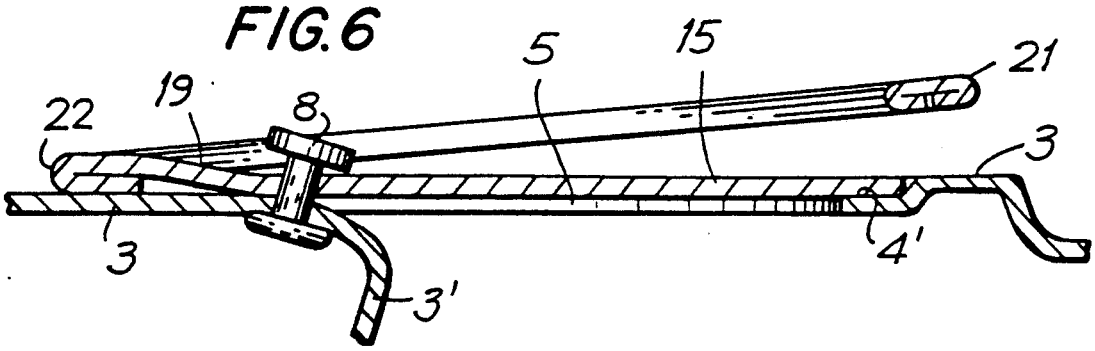

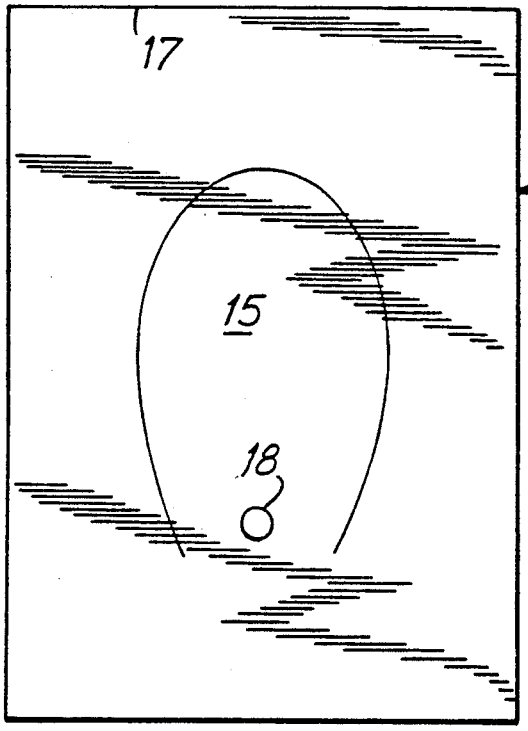
FIG. 7
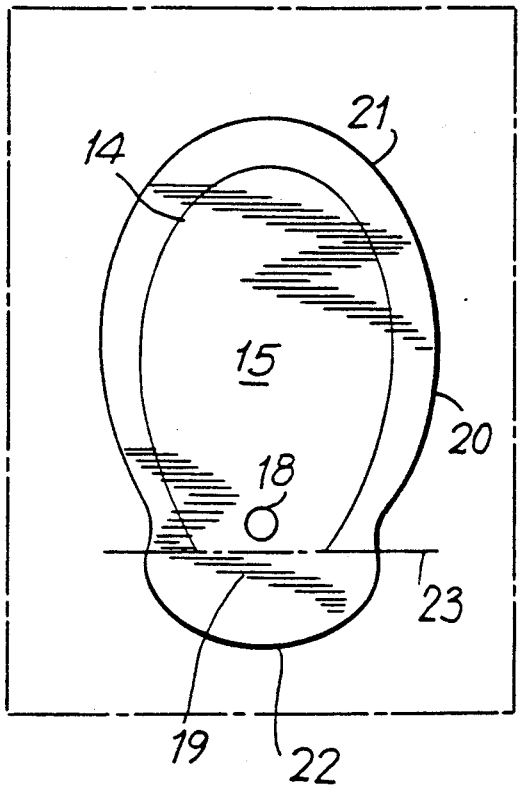
FIG. 8
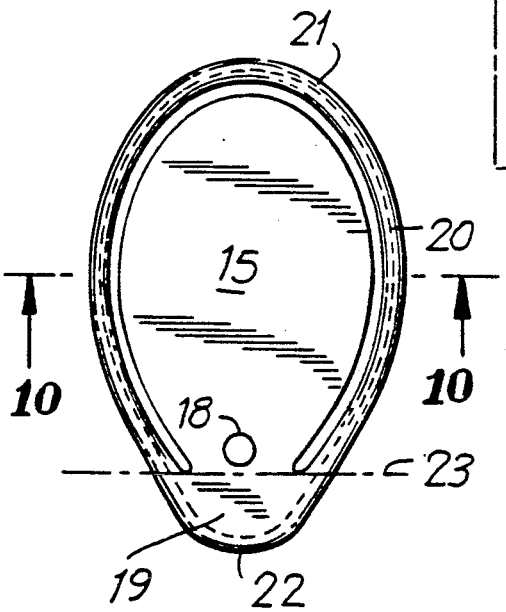
FIG. 9
FIG. 10
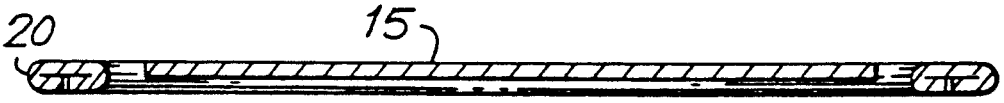

FIG. 11
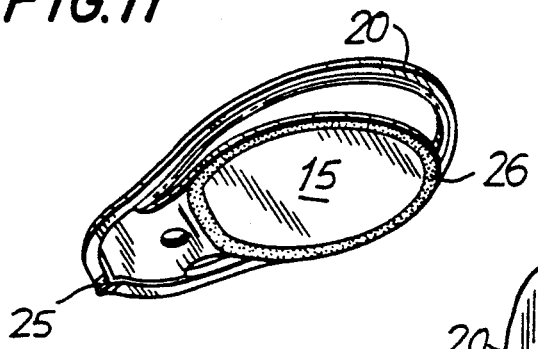
FIG. 12
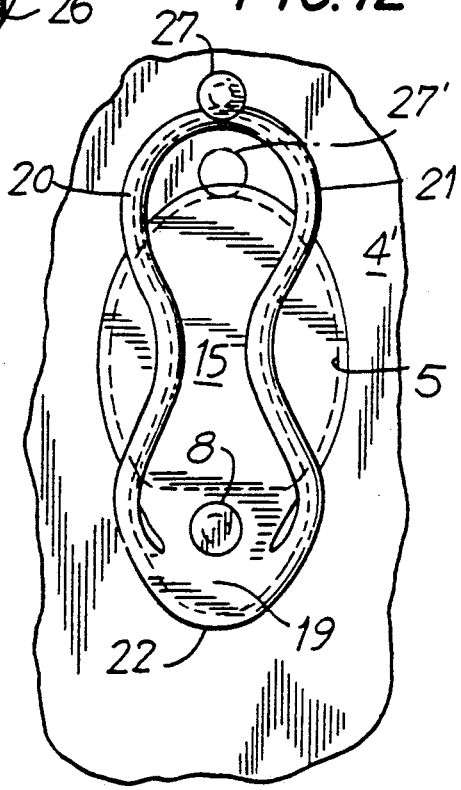
FIG. 13
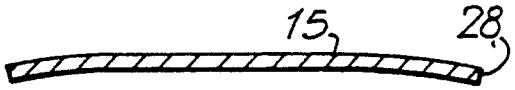
FIG. 14
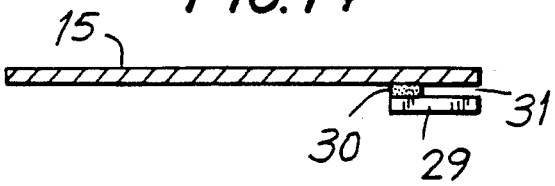
FIG. 15
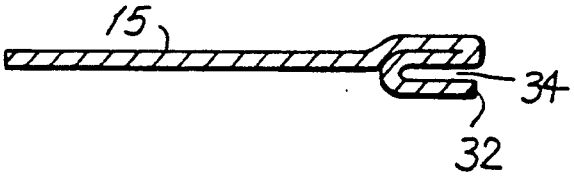
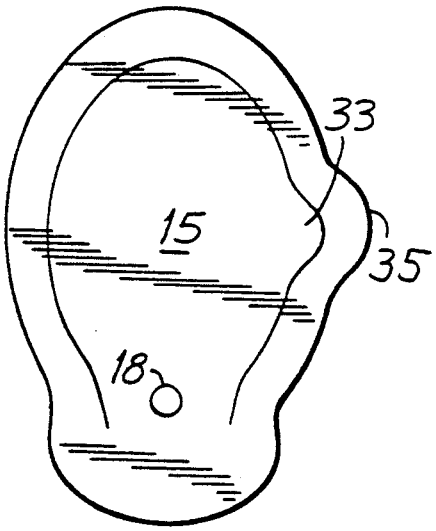
FIG. 16

CONTAINER AND CLOSEABLE PULL TAB

This is a division of application Ser. No. 07/574/637, filed Aug. 29, 1990 now U.S. Pat. No. 5,080,249.

BACKGROUND OF THE INVENTION

The present invention relates to a pull tab for a container, such as a beverage container, which can be operated to close the opening in the container after the pull tab has been used to create the opening The typical beverage container available on the market today includes a top wall with a score line formed to a drinking opening. A pull tab is connected to the top wall of the container for pivoting motion about its point of connection for pressing one end of the pull tab into the top wall area inside the boundary of the score line. This motion is effected by pulling the opposite end of the pull tab upwardly with respect to the top wall of the container. This causes rupturing of the score line and pivoting of the enclosed wall portion downwardly into the container.

Pull tabs of the typical construction described above provide no means for sealing the drinking opening once it has been created. In many situations this is not a significant problem. However, there are occasions where it can be desirable to close the drinking opening once it has been created in a manner which at least retards loss of carbonation of the contents or spilling of the contents if the container is accidentally knocked over.

Attempts have been made in the past to construct pull tabs with sealing closures for covering the drinking opening once formed. Such pull tabs and closures for containers are disclosed in the following U.S. Pat. Nos. 4,077,538; 4,232,797; 4,433,792; 4,442,950; 4,580,692; 4,605,141; 4,720,022; 4,784,283; 4,865,215; and 4,915,290. Many of the constructions disclosed in these patents are rather complicated in construction in that they either include multiple parts or deviate substantially from the typical pull tab presently available. They also require manufacturing procedures quite different from those presently used for forming the typical pull tab.

Of the constructions disclosed in the prior patents, the ones like those in U.S. Pat. Nos. 4,433,792 and 4,605,141 appear closest in construction to the typical pull tab and do include structure for covering the drinking opening once it has been formed. These constructions, however, do not provide any ring-shaped grasping portion on the pull tab as usually included with the conventional pull tab. Further, they require either an engaged relation of the cover in the opening or a hold-down latch for holding the cover sealed against the opening. Also, further dimensional limitations with respect to the spacing between the pivot post for the pull tab and the score line in the container top wall are necessitated in the construction of the '141 patent.

SUMMARY OF THE INVENTION

In accordance with the present invention, a pull tab for containers, such as carbonated beverage containers, is constructed from a single piece of sheet metal with a ring-shaped pull ring and a cover portion. The pull tab is constructed with the cover portion adjacent the pull ring of the pull tab whereby once the pull tab ring has been pivoted upwardly in the normal manner to open the drinking opening, rotation of the pull tab will move the cover portion into covering relation with the drinking opening. The construction of the pull tab and the relative rigidity of the respective parts is such that the movement of the pull tab to the position where the cover portion overlies the drinking opening will cause a biasing of the cover portion into covering, sealing relation with the drinking opening.

With the pull tab of the present invention, the manufacturing procedure employed to form the pull tab is quite similar to the procedure presently used to form the typical pull tab. The only major change needed is one relating to the dimensioning of the different sections of the pull tab relative to each other rather than a difference in manufacturing technique. Thus, the costs of material and with the conventional pull tab.

BRIEF DESCRIPTION OF THE DRAWINGS

FIG. 4 is a fragmentary perspective view of the top of a beverage container with the pull tab of the present invention rotated to a second position closing the drinking opening of the container;

FIG. 5 is a cross-sectional view taken along lines 5—5 of FIG. 4 and similar to FIG. 3 with the pull tab rotated to the second position closing the drinking opening of the container;

FIG. 6 is a cross-sectional view similar to FIG. 5 but on an enlarged scale to show certain details of construction;

FIG. 7 is a plan view of stock piece of sheet metal with a first section of the pull tab formed therein;

FIG. 8 is a plan view of the piece of sheet metal showing the pull tab in an intermediate stage of production;

FIG. 9 is plan view of the formed pull tab of the present invention;

FIG. 10 is a cross-sectional view taken along lines 10—10 of FIG. 9;

FIG. 11 is a bottom perspective view of a modified embodiment of the pull tab of the present invention; and FIG. 12 is a top plan view of a further modified embodiment of the container and pull tab of the present invention;

FIG. 13 is an enlarged cross-sectional view of a modified embodiment of the cover portion of the pull tab similar to the cross-sectional view of FIG. 10;

FIG. 14 is a cross-sectional view similar to FIG. 13 of a second modified embodiment of the cover portion of the pull tab;

FIG. 15 is a cross-sectional view similar to FIG. 13 of a third modified embodiment of the cover portion of the pull tab; and FIG. 16 is a plan view similar to FIG. 8 of a piece of sheet metal showing the pull tab of the embodiment of FIG. 15 in an intermediate stage of production.

DESCRIPTION OF THE PREFERRED EMBODIMENTS

Figure 1:
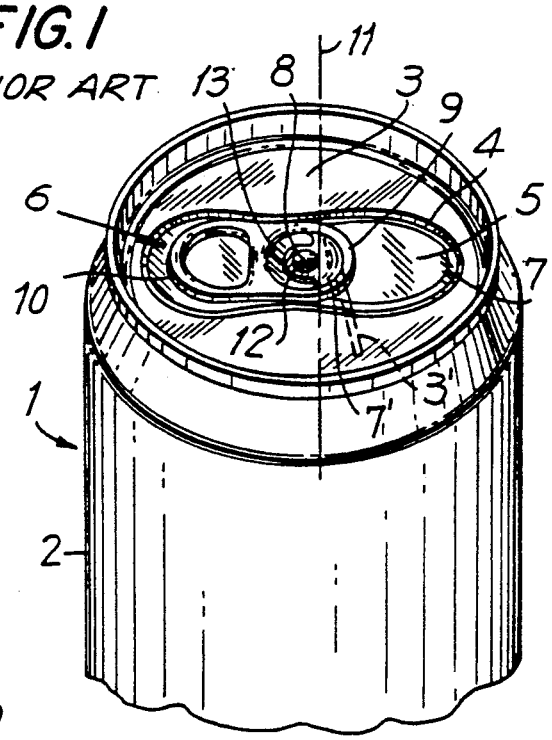
FIG. 1 PRIOR ART
FIG. 1 is a fragmentary perspective view of a beverage container incorporating a typical prior art pull tab.

FIG. 1 shows a conventional beverage container with a conventional pull tab. The container 1 includes a body portion 2 and a top wall 3. The top wall has a recessed area 4 in which the drinking opening 5 and the pull tab 6 are located. In FIG. 1 the drinking opening 5 is still closed by a portion of the top wall surrounded by and defined by a rupturable score line 7. The score line terminates short of completing a circle to provide a hinged area 7' to one side of a pivot post 8 by which the pull tab is rotatably and pivotally attached to the top wall of the container. The pull tab 6 includes a first end 9 overlying the top wall within the boundary of the score line 7 and a ring shaped end 10 extending over the top wall of the container at a location remote from the drinking opening. With this construction pivoting of the pull tab by lifting the pull tab ring 10 will cause the end 9 to move downwardly to rupture the score line and pivot the enclosed wall portion to the dotted line position shown at 3' in FIG. 1. The pivoting of the pull tab is generally about a pivot axis 11 disposed at the edge of the pivot post 8 and the adjacent section of the score line 7.

To permit the pivoting of the pull tab in the manner described above, it is constructed with a mounting from which the pull tab is made. The section 12 is connected to the pivot post 8 of the top wall of the container. Further, the edge defining the end 9 of the pull tab as well as the sides and ring shaped portion 10 which is adapted to be grasped by the user are reinforced by bending the sheet metal out of the plane of the sheet metal. Typically the entire edge of the pull tab is folded over on itself to provide this reinforcement. Finally, although the pull tab is rotatably connected to the pivot post 8, this is of little if any value in the prior art type of construction shown in FIG. 1.

In accordance with the teachings of applicant's invention, the pull tab for the prior art type of container shown in FIG. 1 is constructed with a first section 14 defining a cover portion 15. The cover portion is of a size at least as large as the opening 5 so that it will cover the opening when positioned in overlying relation therewith. As will be appreciated when comparing FIGS. 1 and 2, the cover portion of the pull tab of the present invention is constructed by greatly enlarging the mounting section 12 of the pull tab o f the prior art.

As further shown in FIG. 7, the pull tab is constructed from a single piece of sheet metal 16 with the cover portion 15 being formed by cutting the piece of sheet metal to the appropriate pattern. This is done at a location intermediate the outer boundary 17 of the sheet metal.

Figure 2:
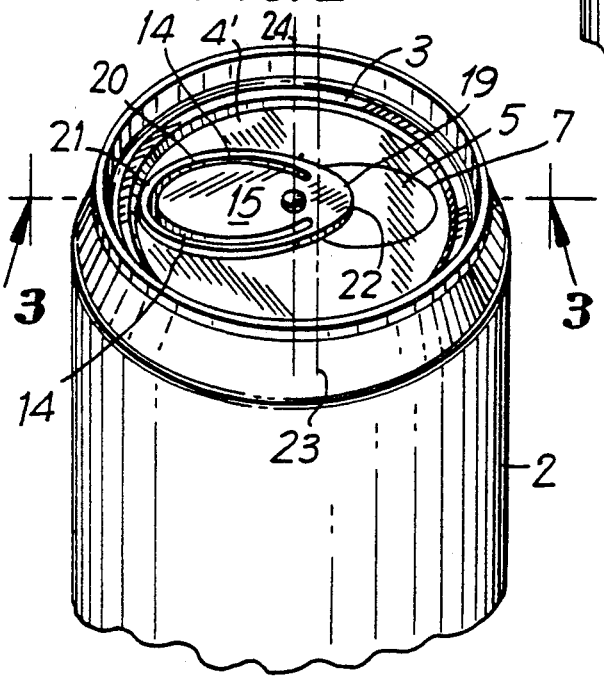
FIG. 2 is a fragmentary perspective view of a beverage container incorporating the pull tab of the present invention, showing the pull tab in a first position before opening of the container.

A hole 18 is also cut into the first section. This hole is of a size compatible with the pivot post 8 of the container top wall so as to provide a connecting means for connecting the finished pull tab to the top wall of the container as shown in FIG. 2. Like the prior art, this connection is a rotatable connection. Unlike the prior art, however, the rotatable connection of the pull tab of the present invention provides a specific and necessary function as more fully described below.

The pull tab of the present invention further includes a second section 19 which is integrally formed with the first section 14 since it is made from the same piece of sheet metal. This section is formed similarly to the first section 14 by cutting the piece of sheet metal to the required shape as shown in FIG. 8.

Finally, the pull tab of the present invention includes a pull tab ring 20. As shown in FIG. 8, the pull rab ring 20 is also formed from a cutting operation performed on the piece of sheet metal, using the material of the sheet metal which surrounds the first section. Preferably, a single die cutting operation is employed to produce all the required cutting to form the shape of the pull tab in its intermediate state of production as shown in FIG. 8.

The pull tab ring is formed integrally with the second section of the pull tab and includes a grasping portion 21. The ring extends from the second section into surrounding relation with the cover portion 15. The ring 20 and the leading edge 22 of the second section 19 of the pull tab are all reinforced. This is effected by bending of the sheet material upon itself to form a double thickness of sheet metal as shown in FIGS. 9 and 10. This double thickness extends continuously from the front edge 22 through the pull tab ring 20 and the grasping portion 21 of the ring so as to provide a relatively rigid structure.

Figure 3:
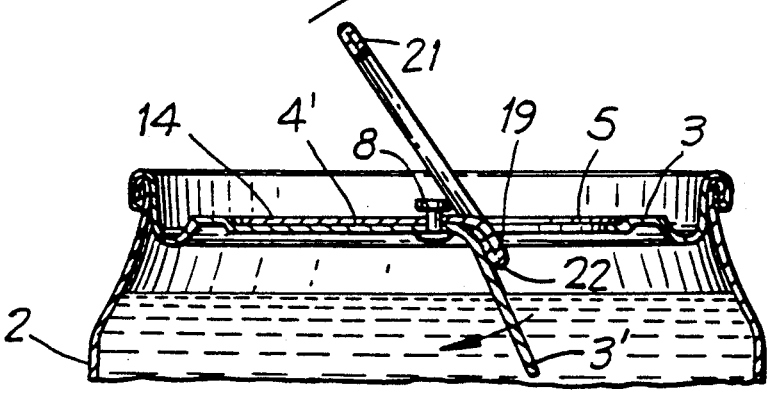
FIG. 3 is a cross-sectional view taken along lines 3—3 of FIG. 2 of the top of a beverage container incorporating the pull tab of the present invention shown with the pull tab in the first position after opening the container.

As shown in FIG. 9 the cover portion 15 is positioned on one side of the hole 18 by which the pull tab is mounted onto the container while the second section is positioned on the other side of this point of mounting. With the pull tab mounted on the container as shown in FIGS. 2 and 3, raising of the grasping portion 21 of the ring 20 causes pivoting of the rigid ring and first section 19 about a pivot axis 23. This pivot axis 23 is shown in FIG. 9 and defines the line of demarcation between the first and second sections of the pull tab. With the location of the pivot post 8 on the container closely adjacent to the opening 5 as shown in FIG. 2, the pivot axis 23 will be located between the edge of the opening 5 and the pivot post 8.

As shown in FIG. 3, the pivoting of the ring 21 and the second section 19 is relative to the first section 14 and the cover portion 15 which remains in flat position over the top wall of the container. The pivoting of the pull tab ruptures the score line 7 due to the downward pressure of the leading edge 22 of the pull tab against the top wall enclosed by the score line. This has the result of pivoting this portion of the top wall downwardly into the container to the position where it is designated by reference numeral 3' in FIG. 3.

When it is desired to close the filling opening, the pull tab is rotated from the first position shown in FIGS. 2 and 3 to a second position shown in FIGS. 4 and 5. As this rotation occurs, the cover portion 15 is rotated into overlying covering relation with the drinking opening 5. Due to the reinforced rigidity of the pull tab ring 20 and leading edge 22 relative to the first and second sections of the pull tab, particularly along the pivot axis 23, the ring and leading edge remain rigid as they are pivoted in the direction reverse from the pivoting movement during opening of the container. This reverse pivoting is assured as the edge 22 rotates away from the opening 5 since the edge 22 is moved into overlying engaging relation with the top wall of the container.

Furthermore, as this rotation occurs, the engagement of the container top wall with the edge 22 of the pull tab creates a positive biasing force acting on the edge 22 and urging it upwardly from the position to which it was pivoted during opening of the container. This, in turn, has the effect of biasing the cover portion 15 downwardly against the top wall of the container where it surrounds the opening 5, thus enhancing the integrity of the sealing of the opening 5. As shown in FIGS. 4 and 5, the cover portion fits within a recessed area 4' with its outer bottom surface seated on the edge of top wall of container defining the opening 5. The recessed area 4' is shaped to permit rotation of the cover portion without moving out of the recess. This eliminates any upward movement of the cover portion as it is rotated from the first to the second position which could act against the downward biasing force.

The biasing of the cover portion downwardly by the upward biasing of the edge 22 is further facilitated by the built in flexibility of the container top wall relative to the pull tab ring 20 and edge 22 of the pull tab. In particular, the top wall of the container at the pivot post 8 is a single thickness of metal and is more flexible than the pull tab ring 20 and edge 22. This flexibility, as far as the present invention is concerned, is along an axis 24 extending generally through the pivot post and parallel to the pivot axis 23. Thus, the upward biasing of the edge 22 of the pull tab as it is rotated to the position shown in FIGS. 4 and 5 causes a flexing of the container wall along the axis 24 and a corresponding tilting of the pivot post. This is most clearly shown in the enlarged view in FIG. 6. The result is a further biasing of the cover portion 15 downwardly to close the opening 5 by tight pressure engagement of the cover portion with the peripheral recessed area 4' of the top wall 3 immediately surrounding the opening 5.

As shown in FIG. 11, the biasing of the edge 22 upwardly when in the position shown in FIG. 5 can be further enhanced by providing a protrusion 25 on the edge 22. This protrusion extends downwardly a distance sufficient to cause pivoting of the pull tab ring 20 into flat overlying relationship with the opening of the container. This further pivoting acts to further tilt the pivot post 8 about the axis 24 and to further bias the cover portion 15 against the top wall of the container where it surrounds the opening 5. The protrusion can be formed in the edge 22 by a crease during the manufacturing process.

As shown in FIG. 11, the under surface of the cover portion 15 of the pull tab in this embodiment is provided with a sealing surface 26. This sealing surface extends around the periphery of the bottom surface of the cover portion 15. A suitable sealing material may be coated onto the cover or a separate piece can be attached.

FIG. 12 shows an embodiment of the invention in which the pull tab ring is shaped to overly the cover portion 15 of the pull tab. This is particularly useful when the pull tab is further provided with the protrusion 25. Thus, when the ring is caused to lie flat relative to the top wall of the container, it will engage and actually press the underlying cover 15 against the top wall.

As shown in FIG. 12, the container top wall can be provided with a latch 27 for holding the pull tab ring down against the top wall of the container when the pull tab is positioned with the cover portion 15 overlying the opening 5. This latch is preferably in the shape of a headed post and is formed from the material out of which the top wall of the container is formed in the same way as the pivot post 8. With the pull tab ring 20 overlying the cover portion 15, this construction will hold both parts tightly against each other and the cover portion against the top wall. Alternatively, the latch can be positioned on the container top wall so that the cover portion 15 of the pull tab can be positioned and held under the latch. This is shown in dotted lines at 27' in FIG. 11.

FIGS. 13–16 show alternative embodiments of the cover portion 15 of the pull tab. These modifications are for the purpose of enhancing the sealing of the cover portion over the opening of the container top wall.

In the embodiment shown in FIG. 13 the cover portion 15 is bent downwardly along its peripheral edge 28. This adds strength to the cover portion and lessens any tendency the cover portion may have to curl upwardly.

FIG 14 shows another embodiment of the cover portion 15 in which a separate locking latch 29 is provided. The latch is attached to the bottom surface of the cover portion by solder 30 or other suitable means. As shown in FIG. 14, the location of the latch is to the side of the cover portion and provides a slot 31 for receiving the edge of the top wall of the container surrounding the opening 5. With this construction, rotation of the cover to the closed position locks the cover in sealed position over the opening by engagement of the edge of the top wall within the slot 31.

FIG. 15 shows still another embodiment of the invention which also provides a locking latch for the cover portion 15. In this construction, however, the latch 32 is formed out of the same piece of sheet metal from which the cover portion 15 is formed. This can be done by cutting the latch 32 as a side extension 33 of the cover portion as shown in FIG. 16. To provide the locking slot 34 the latch 32 is bent in a double bend against the bottom surface of the cover portion. Further, to align the slot immediately below the bottom surface of the cover portion, the latch and overlying edge of the cover portion are formed to a raised level. This insures full engagement of the cover portion with the top wall of the container in the closed position of the pull tab.

Finally, as shown in FIG. 16, the formation of the latch 32 is from material that would otherwise be used for the formation of the pull tab ring. To the extent that this might result in an unacceptable reduction in the strength of the formed ring, the cutting of the material to form the ring can be modified to form an extended outer boundary 35 in the area of the side extension 33.

I claim:

1. The method of making a pull tab for a container having a body and top wall with a rupturable score line in the top wall defining the outline of a closed opening, and a pivot post adjacent said opening for mounting a pull tab, the method comprising:

a) providing a single piece of sheet metal;

b) cutting the piece along a line to provide a first section with one part thereof remaining attached to the piece, said first section defining a cover portion of a size at least as large as said opening for covering said opening after rupturing of said score line, said first section being spaced from the surrounding outer edge of the piece to leave sheet metal surrounding the first section;

c) forming a connecting means in said first section for connecting the pull tab to said pivot post for rotation between a first position with the cover portion overlying the top wall at a location spaced from said opening to a second position with the cover portion covering said opening, said cover portion being positioned on one side of the connection means;

d) forming a second section being integral with said first section at the said part and extending therefrom on the other side of said connecting means;

e) forming a reinforced edge portion on said second section for engaging with the top wall of the container within the outline defined by said score line when said pull tab is in said first position to rupture the score line and open said opening upon pivoting of the second section about a pivot axis and downwardly relative to said top wall; and f) forming a pull tab ring from the metal of said piece surrounding the cover portion with the ring extending from said second section and connected thereto for pivoting with said second section relative to said first section to pivot the second section downwardly about said pivot axis upon raising of the pull tab ring relative to said top wall when said pull tab is in said first position.

2. The method according to claim 1 further comprising:

a) reinforcing the pull tab ring as a continuation of the reinforced edge of said second section.

3. The method according to claim 2 further comprising:

a) shaping the pull tab ring to overlie the cover portion of the pull tab.

4. The method according to claim 2 further a) forming a protrusion on the edge portion of the second section for extending downwardly toward the top wall of the container a sufficient distance to pivot the pull tab ring into flat overlying relationship with the opening in the container top wall when said pull tab is in said second position with the protrusion engaging the top wall.

5. The method according to claim 1 further comprising:

a) forming a locking flange on its bottom surface of the cover portion adjacent the edge thereof and slightly spaced from the bottom surface of the cover portion adjacent said edge to define a slot for reception of the edge of the top wall of the container when said pull tab is in said second position on the container top wall.

6. The method according to claim 5 wherein:

a) the locking flange is formed by i) forming an extension on the side edge of the cover portion, and ii) folding the extension over into a double bend against the bottom surface of the cover portion.

* * * * *